US008662088B2

(12) United States Patent
Owczarek et al.

(10) Patent No.: US 8,662,088 B2
(45) Date of Patent: Mar. 4, 2014

(54) APPARATUS FOR FILLING A CAVITY, FILLING STATION AND METHOD OF FILLING A CAVITY

(75) Inventors: Radoslaw Owczarek, Radom (PL); Adam Gielniewski, Radom (PL)

(73) Assignee: International Tobacco Machinery Poland SP . Z O.O., Radom (PL)

( * ) Notice: Subject to any disclaimer, the term of this patent is extended or adjusted under 35 U.S.C. 154(b) by 0 days.

(21) Appl. No.: 13/883,574

(22) PCT Filed: Nov. 30, 2011

(86) PCT No.: PCT/PL2011/050048

§ 371 (c)(1), (2), (4) Date: May 14, 2013

(87) PCT Pub. No.: WO2012/074422

PCT Pub. Date: Jun. 7, 2012

(65) Prior Publication Data

US 2013/0284188 A1 Oct. 31, 2013

(30) Foreign Application Priority Data

Dec. 1, 2010 (PL) ..... 393103

(51) Int. Cl.

| | |
|---|---|
| ***A24C 1/14*** | (2006.01) |
| ***B65B 19/34*** | (2006.01) |
| ***B65G 47/26*** | (2006.01) |

(52) U.S. Cl.

USPC ..... 131/282; 53/148; 53/150; 53/147; 53/236; 53/444; 53/244; 53/245; 53/248; 53/249; 53/473; 198/418; 221/222; 221/208

(58) Field of Classification Search

USPC ..... 131/282; 53/147, 236, 444, 148, 150, 53/244–245, 258–249, 473; 198/418; 221/222, 208

See application file for complete search history.

(56) References Cited

U.S. PATENT DOCUMENTS

| | | | |
|---|---|---|---|
| 2,919,529 | A | 1/1960 | Hillman |
| 3,320,717 | A | 5/1967 | Molins |

(Continued)

FOREIGN PATENT DOCUMENTS

| | | | |
|---|---|---|---|
| DE | 1066118 | A | 9/1959 |
| DE | 3103836 | A1 | 1/1982 |

(Continued)

OTHER PUBLICATIONS

International Search Report in PCT/PL2011/050048, dated Mar. 15, 2012.

(Continued)

*Primary Examiner* — Richard Crispino
*Assistant Examiner* — Dionne Walls Mayes
(74) *Attorney, Agent, or Firm* — Oppedahl Patent Law Firm LLC

(57) ABSTRACT

Apparatus and method for filling under gravity from a hopper (9), a storage device (2) for articles that has the form of a columnar cavity between opposed side walls with a mass flow of mutually parallel rod-shaped articles descending from the hopper, a cavity-filling device (12) that alternates in use between a closed configuration that blocks a downward flow of the said articles through the device and an open configuration that allows flow of the articles through the device, the device being movable in translation, in alternate upward and downward strokes within the cavity, being in the closed configuration on the downward stroke and in the open configuration on the upward stroke.

16 Claims, 7 Drawing Sheets

(56) References Cited

U.S. PATENT DOCUMENTS

| | | | | |
|---|---|---|---|---|
| 4,489,534 | A | 12/1984 | Gömann | |
| 7,757,465 | B2 * | 7/2010 | Budny et al. | 53/473 |

FOREIGN PATENT DOCUMENTS

| | | | |
|---|---|---|---|
| DE | 3809689 | A1 | 12/1989 |
| DE | 3819384 | A | 12/1989 |
| DE | 3708791 | A1 | 9/1998 |
| EP | 920815 | A1 | 6/1999 |
| EP | 1955604 | A1 | 1/2000 |
| EP | 968663 | A2 | 5/2003 |
| EP | 1795076 | A1 | 6/2007 |
| GB | 877876 | A | 9/1961 |
| GB | 2062567 | A | 5/1981 |

OTHER PUBLICATIONS

Written Opinion in PCT/PL2011/050048, dated Mar. 15, 2012.

* cited by examiner

APPARATUS FOR FILLING A CAVITY, FILLING STATION AND METHOD OF FILLING A CAVITY

This invention relates to apparatus for filling a cavity, a filling station and method of filling a cavity, in particular apparatus for filling under gravity from a hopper, a storage device for articles, the storage device having a form of a columnar cavity between opposed side walls, with a mass flow of mutually parallel (or substantially mutually parallel) rod-shaped articles descending from the hopper.

The apparatus is useful for filling a cavity with rod-shaped articles that are cigarette rods or cigarette filter rods or other tobacco products (such as cigars or cigarillos).

The tobacco industry presents specific challenges for handling a mass flow of articles. Cigarette rods and filter rods are physically delicate and fragile, but are handled in enormous numbers, when manufacturing packs of cigarettes. To handle a mass flow of cigarette rods from a cigarette maker to a cigarette packer, it is conventional to employ a so-called "tray" for temporary storage of cigarette rods and filter rods. Such a tray is known with only one chamber for storing the rods (i.e. with one columnar cavity), but trays are also known with a plurality of chambers, typically arranged as a single row of columnar cavities, each of which is defined by a pair of opposed side walls, each such side wall defining a thin partition between two adjacent columnar cavities in the row. The present invention has particular application to the filling of such trays but is also used for the filling of single chamber trays. In the further part of the description the name "storage device" can be replaced with the name "tray" respectfully single chamber tray or multi-cavity tray. The term "product" can be replaced with the term "article" or "rod-shaped article".

There is a long history of proposals for filling trays with cigarette rods or filter rods, in a way that will enable to achieve close-packing of the rods, with a minimum of free space and voids between adjacent rods. The closer the rods can be packed, in perfect symmetry, the less likely it is that one or other of the rods will suffer physical damage in the tray. Besides, perfect close packing of the rods will make maximum use of the storage capacity of any one tray.

Over the years, there have been numerous proposals for filling such trays with cigarette rods or filter rods. Such proposals include those of U.S. Pat. No. 2,919,529, DE-A-1066118, GB-A-2062567, DE-A-3103836, U.S. Pat. No. 4,489,534, German A publications numbers 3708791, 3809689, 3819384 and 19829735. Also of interest are EP-A-920815 and EP-A-1955604.

Many of the prior proposals involve gradual downward movement of a tray, relative to a supply station, as the supply station delivers rods into the columnar cavities of the tray. In this way, the distance that an individual rod falls, when advancing out of the supply station and into the cavity of the tray, is reduced to a minimum. Once the tray has descended far enough that its columnar cavities are full, the supply of rods to those cavities can be terminated temporarily, to enable the full tray to be taken away and a fresh empty tray to be advanced into a position where its floor is immediately adjacent below the supply station, ready for the supply to be resumed and that fresh tray to be lowered gradually, during the filling process.

It is an object of the present invention to achieve improvements in filling of trays with objects such as cigarette rods or filter rods.

SUMMARY OF THE INVENTION

The present invention provides apparatus for filling under gravity from a hopper, a storage device for articles that has the form of an columnar cavity between opposed side walls, with a mass flow of mutually parallel rod-shaped articles descending from the hopper, characterised by a cavity-filling device that alternates in use between a closed configuration that blocks a downward flow of the said articles through the device and an open configuration that allows flow of the articles through the device, the device being movable in translation, in alternate upward and downward strokes within the cavity, being in the closed configuration on the downward stroke and in the open configuration on the upward stroke.

The present invention provides also apparatus, wherein the cavity-filling device comprises a first set of mutually parallel co-planar elongate bars. The bars of the first set being spaced apart at regular intervals widely enough to permit the articles to slide between the bars. Further apparatus comprises a second set of mutually parallel co-planar bars. The bars of the second set being spaced apart at regular intervals such that, in the closed configuration, at least one bar of the second set obstructs each gap between the bars of the first set through which articles flow when the device is in its open configuration.

According to the invention the bars of the first set have a rectangular cross-section and are mounted for rotary motion while the bars of the second set have a circular cross-section.

According to the invention alternation between the said open and closed configuration is accomplished by a linear relative movement of the first bar and second bar sets in translation, transverse to the upward and downward direction.

According to the invention the bars of the first set are rotatably mounted on a support and the bars of the second set are mounted on a horizontally moveable beam arranged below of the bars of the first set.

The apparatus according to the invention is arranged for filling a storage device which is a tray that has a plurality of side walls that defines a single row of said columnar cavities, the apparatus being adapted to fill simultaneously a plurality of the columnar cavities in the row.

According to the invention in the apparatus including said hopper wherein the cavity-filling device prior to its downward stroke serves in its closed configuration as a shutter that closes an outlet in the base of the hopper.

According to the invention the apparatus includes means to actuate the cavity-filling device in dependence upon the fill state of the storage device beneath the cavity-filling device.

According to the invention the apparatus includes means to move the cavity-filling device upwards at a steady speed and downwards at a steady speed.

According to the invention there is provided a filling station for filling a succession of empty storage devices with mutually parallel rod-shaped articles, comprising a hopper, a filling apparatus according to the invention and a transport device for advancing a succession of the empty storage devices to a filling position beneath the filling apparatus and then advancing the storage devices, when full, out of the filling position.

According to the invention there is provided a method for filling succession of storage devices under gravity from a hopper, with a mass flow of mutually parallel rod-shaped articles, each storage device having the form of a columnar cavity between opposed side walls, the method comprising the steps of:

- arranging a cavity-filling device under the hopper, the device is in a closed configuration that blocks a downward flow of the said articles through the device;
- placing an empty storage device under the cavity-filling device;

moving the cavity-filling device downward as far as a base wall of the storage device;

shifting the device from the closed configuration to an open configuration that allows flow of the articles through the device;

moving the device upwards close to a top of the storage device;

shifting the device from the open configuration to the closed configuration; and replacing the filled storage device with another empty storage device.

According to the invention the method, wherein the cavity-filling device comprises a first set of mutually parallel co-planar elongate bars, the bars of the first set being spaced apart at regular intervals widely enough to permit the articles to slide between the bars, and a second set of mutually parallel co-planar bars, the bars of the second set being spaced apart at regular intervals thereby providing such that at least one bar of the second set obstructs each gap between the bars of the first set when shifting the device from the open configuration to the closed configuration, and wherein the shifting step comprises shifting the bars of the second set laterally with respect to the first set of bars and the tray.

According to the invention the method further comprises the step of:

performing a rotary motion of the bars of the first set and/or the bars of the second set during upward and/or downward movement.

According to the invention the method further comprises the step of:

moving the cavity-filling device upwards and downwards at a constant speed.

According to the invention the method is used to fill simultaneously a plurality of the columnar cavities of a multi-compartment tray.

With the method and apparatus of the present invention, one can visualise any one or more of the following enhancements of performance:

1. A closer approach to perfectly close packing in the arrangement of product items within the cavity of the storage device filled with those items.
2. A greater level of confidence that the filling process will not do physical damage to any one of the articles.
3. A potential to increase the rate of filling of storage cavities.
4. A potential to reduce the physical size of the filling station.
5. Greater reliability of filling, leading to a reduced amount of "downtime" at the filling station.
6. A higher level of confidence that there will be no "spillage" of product items, released from a hopper but failing to be captured in the intended storage cavity.

Turning to the specifics of the cavity-filling device, Applicant envisages a first set of mutually parallel co-planar elongate bars, the bars of the first set being spaced apart at regular intervals widely enough to permit the articles to slide between the bars. Then there is a second set of mutually parallel co-planar bars, the bars of the second set being spaced apart at regular intervals such that there is at least one bar of the second set available to obstruct each gap between two adjacent bars of the first set. In operation, the second set of bars would occlude the gaps between the bars of the first set, during the downstroke, so that the first and second bar sets together support the rod articles just above the bar sets in the hopper, the downstroke of the cavity-filling device permitting a mass flow of parallel product articles to flow down, under gravity, into the cavity in which the cavity-filling device is descending. Then, when the cavity is full and the cavity-filling device is at the floor of the full cavity, the bars of the second set will move laterally so that each takes up a position more or less below one of the bars of the first set, thereby no longer occluding the gaps between the bars of the first set and allowing the product items to pass downwardly between the bars of the first set. In this configuration, the cavity-filling device is then raised gently through the full height of the full cavity, with all the rods in the cavity passing one by one through one or other gap between one or other pair of adjacent bars of the first set of bars (and the second set of bars) of the cavity-filling device, until the upwardly rising cavity-filling device reaches the top of the cavity. At this point, the cavity-filling device is once more up at the level of the base of the hopper, and a reverse movement of the bars of the second set, into the starting configuration where they occlude the gaps between the bars of the first set, will bring the cavity-filling device back to a configuration in which it functions as a shutter at the base of the hopper. At this point, the full tray can be removed and a fresh empty tray brought into position beneath the cavity-filling device, ready for a repeat of the tray filling operation.

It will be appreciated that, with the present invention, there need be no relative movement, during the cavity-filling process, between the hopper and the storage device. Instead, what is envisaged is an absence of such relative movement, during filling, between the hopper and the storage device, the requisite movement to achieve gentle filling being accomplished instead by the downward and upward stroke of the inventive cavity-filling device. This cavity-filling device, in preferred embodiments, functions not only as a shutter in the floor of the hopper, but also as a device for lowering product articles from the hopper to the floor of the cavity of the storage device, with virtually no unmanaged free fall under gravity apart from any residual "settling" of articles below the filling device, into their desired symmetrical close-packed arrangement in the storage cavity. Not only that, but the upward stroke of the cavity-filling device, through the bed of product items filling the cavity, has the potential to ease the product items into the desired close-packed arrangement, and minimise the number of unwanted "voids" and free space between the articles in the cavity below the filling device.

It will also be appreciated by skilled readers that the cavity-filling device can be the only sub-assembly that moves during the filling of the storage device. One can envisage that the space requirements needed for the reciprocating cavity-filling device might be relatively modest. Further, one can envisage a simplified mechanical construction of the filling station, and rapid exchange of a cavity-filling device that is in need of maintenance or repair, with very little downtime in the filling station as such.

Applicant has found it advantageous to select for the bars of the first set a cross-section which is generally rectangular (although the four perpendicular corners of the cross-section will be rounded to some extent, as appropriate to minimise physical damage to the articles being handled). Applicant has also found it effective to arrange for these bars of the first set, with non-circular cross-section, to be mounted all for simultaneous oscillatory rotatory motion about a relatively small angle. This assists the smoothness of throughflow of the product articles past the bars of the first set during the upstroke of the cavity-filling device. Furthermore, the gentle impulse given to the rod-shaped articles during the oscillatory motion can be just enough to assist the rods into a disposition closer to the ideal symmetrical close packed arrangement below the cavity-filling device.

However, a range of other cross-sections are contemplated. Circular cross-sections with a grooved or ridged surface might assist an oscillatory movement of the bars to jiggle the rod-shaped articles into a close-packed array. Non-circular cross-sections with a greater number of faces than four might work as well, or better, than 4-sided bars. While oscillatory rotatory movement is presently preferred, other forms of movement of the bars of the first set, such as small amplitude vibration about their median positions in the bar array, might be equally or more effective to assist through flow of rod articles and their close packing beneath the filling device. Specifically, we envisage small amplitude oscillation, up and down, in the bars of the first set, as a way to defeat any incipient tendency of the rods to "bridge" between and above any particular adjacent pair of bars of the first set.

Conversely, the bars of the second set advantageously have a circular cross-section. They are not well-placed on the upstroke to assist the rod articles into a close packed disposition. Giving them a smooth circular cross-section is one design option. Another is to give them a trapezium cross-section with a pair of parallel faces serving as horizontally arranged upper and lower major surfaces. Conveniently, the bars of the second set are not required to rotate at all during the downstroke or the upstroke, but only to move, in the intervals between the upward and downward strokes, laterally relative to the bars of the first set. This is conveniently accomplished by mounting all the bars of the second set on a common beam that is arranged to move horizontally and laterally below the bars of the first set, between the open and closed configurations of the cavity-filling device.

Although the summary of the invention up to now has been in terms of a cavity-filling device, it will be appreciated that another aspect of the present invention resides in a method for filling a succession of columnar cavities, and a further aspect of the invention resides in a filling station that includes a cavity-filling device as described above.

BRIEF DESCRIPTION OF THE DRAWINGS

For a better understanding of the present invention, and to show more clearly how the same may be carried into effect, reference will now be made, by way of example, to the accompanying drawings, in which.

DETAILED DESCRIPTION OF PREFERRED EMBODIMENTS

Figure 1:
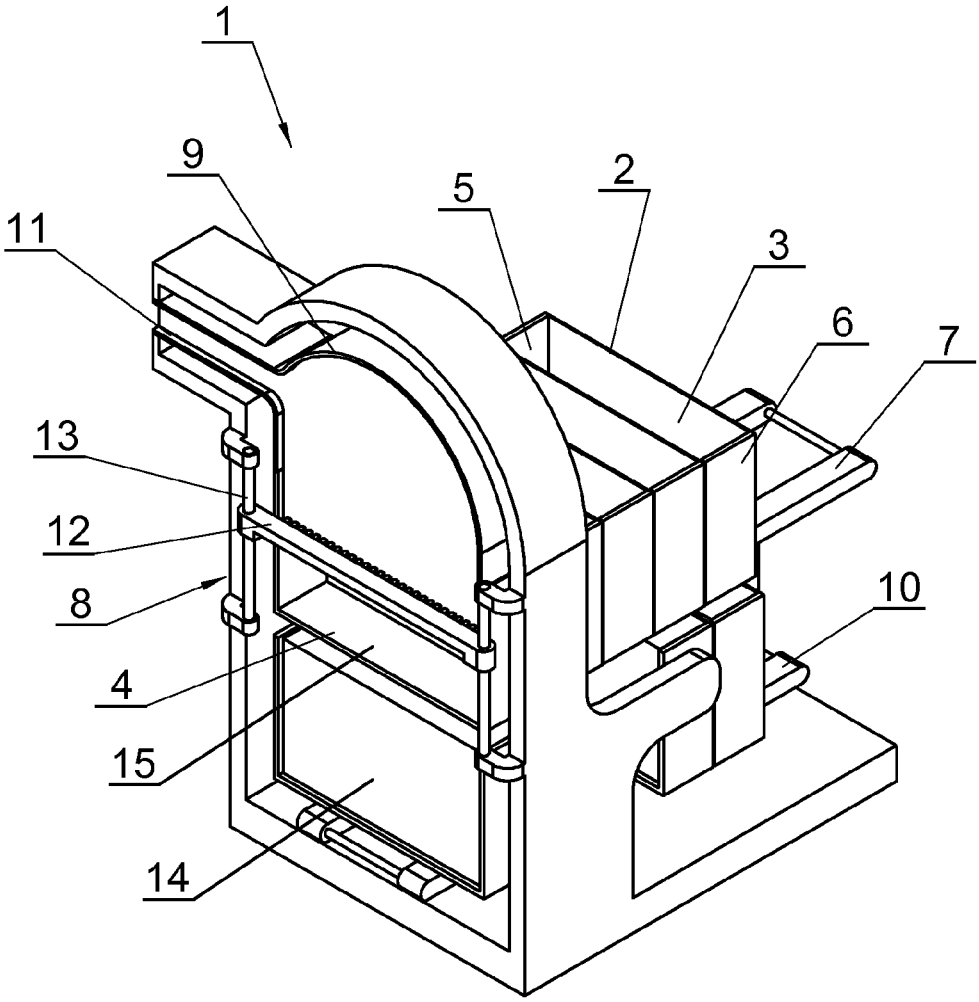
FIG. 1 is an isometric view of a first embodiment of filling station that includes a cavity-filling device according to the present invention, the filling station being in a first disposition, ready to receive an empty single compartment tray.

The filling station 1 in FIG. 1 exhibits an input zone in which empty trays 2 are presented for filling on the station. Each tray has a back wall 3 and parallel side walls 5 and 6 with a cavity in-between. Full trays are carried along on an input conveyor 7 to a filling region 8 of the filling station. The tray of FIG. 1 exhibits just a single cavity. Each tray has a base surface 4 that spans between the opposed side walls 5 and 6 of its single full width cavity. Empty trays are carried along on an input conveyor 7 to a filling region 8 of the filling station. A hopper 9 for rod-shaped articles such as cigarette rods or cigarette filter rods is fed from an input conveyor 11 and another input conveyor 7 brings empty trays to the filling station in which a filling device 12 is carried on vertical guides 13 so that it can perform an upstroke and a downstroke relative to the hopper 9. FIG. 1 shows a full tray 14 on the output conveyor 10, after having been lowered away from the filling region 8. The single tray 15 shown with base surface 4, at present in the filling region 8, has to be filled and then lowered to the output conveyor 10, clear of the filling region, to leave the space there free for the next empty tray to be brought into the filling region by the input conveyor 7. Full trays are carried away on an output conveyor 10 from a filling region 8 of the filling station.

Figure 2:
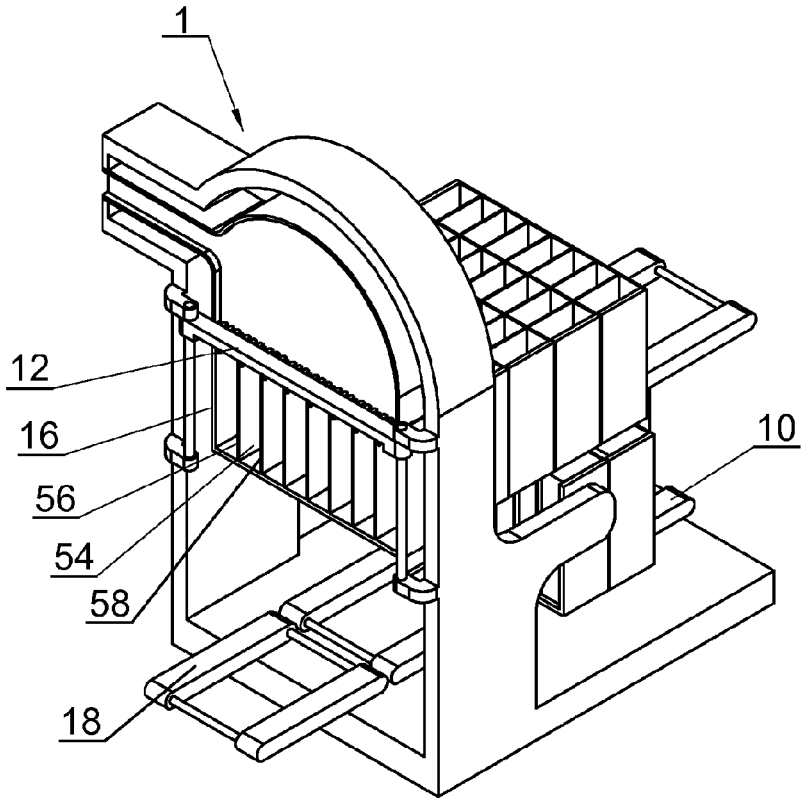
FIG. 2 is a view of a second embodiment of filling station, in a second disposition, that includes a multi-compartment tray ready to be filled.

Moving on to FIG. 2, we see a succession of multi-compartment trays, with the next empty tray 16 having been conveyed into the filling region 8. In this drawing, tray 16 exhibits a single row of eight cavities, but operation of the present filling device is well-adapted equally for filling trays with a different number of columnar cavities. FIG. 2 shows an additional conveyor 18 below the filling station and useful for conveying improperly filled trays out of the filling station in a direction opposite to the direction, along conveyor 10, which properly filled trays take.

Readers will find it helpful, in the following description, to compare each isometric view with the corresponding sectional view, as the process proceeds. See also FIG. 19. We begin with FIG. 2 and FIG. 6. In each of the sectional views FIGS. 6 to 15, we show (for the sake of clarity) the bars in only one columnar cavity and only the single next adjacent bar in the adjacent columnar cavity each side of the illustrated cavity. The drawings are not to scale.

Figure 6:
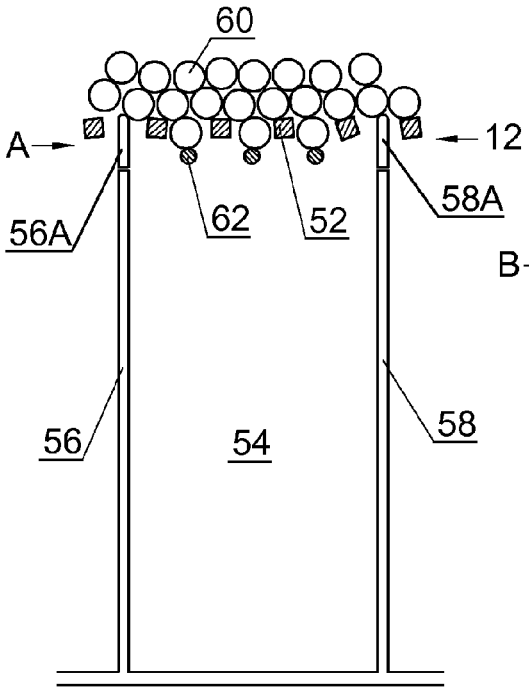
FIG. 6 is a schematic section through one cavity of the tray of FIG. 2, showing the cavity-filling device serving as a shutter at the base of a hopper.

The filling device 12 is embodied in a first set of square section bars 52 cantilevered from the main beam of the filling device 12. For more detail, see FIG. 19 below. In FIG. 6, we see a single columnar cavity 54 between opposed sidewalls 56 and 58, the cavity 54 being just one of the eight cavities visible in FIG. 2. FIG. 6 shows four square section bars 52. With eight columnar cavities, that would make a full set of 4×8=32 bars in the first set of bars of the filling device. Readers will appreciate that there may be more or less than 32 bars in the first set, depending on the relative dimensions of the product articles and the number of columnar cavities, and the width of each such cavity.

Co-linear with the walls 56 and 58, and above them, are depending stationary stub walls 56A and 58A carried by the hopper and extending downwardly from the base of the hopper 9.

The gaps between members of the set of square bars 52 are wide enough to permit throughflow of product items 60, except when the bars 62 of the second set of bars of the filling device are arranged to occlude the gaps between adjacent square bars 52. It can readily be seen in the section of FIG. 6 that when the circular section bars 62 are each arranged to occupy a position halfway between the two square bars of the first set immediately above, that will be enough to prevent product items 60 from advancing through the gaps between the bars of the first set. In this way, the first and second sets of bars and the stub walls 56A, 58A together function as a shutter to prevent any downward flow of product items out of the hopper 9 into the cavity 54.

Figure 7:
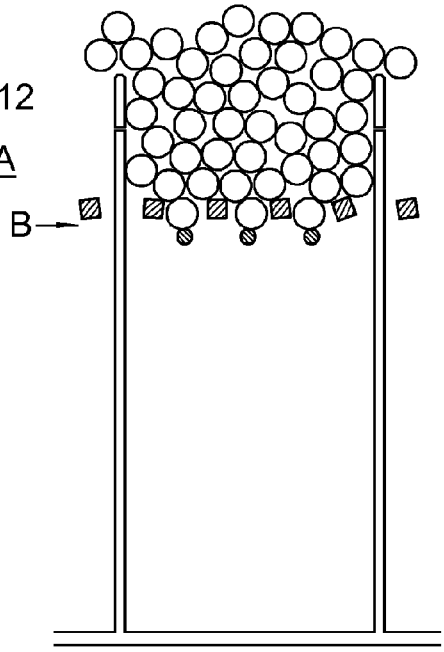
FIG. 7 is a section like FIG. 6, but through the filling device at the point shown in FIG. 3.
Figure 12:
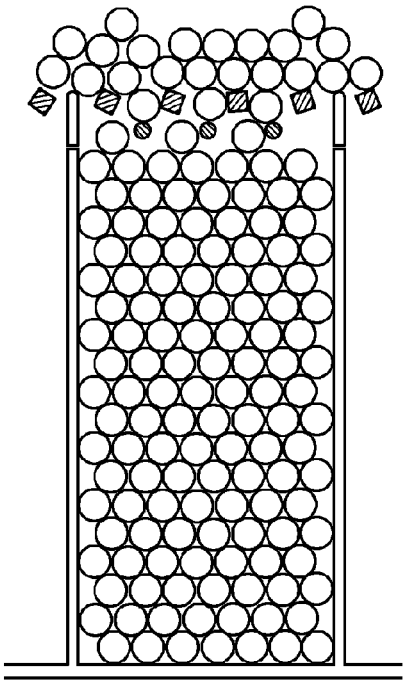
FIG. 12 is a section like that of FIGS. 6 to 11, with the filling device at the same vertical height as in FIG. 11 but with the circular cross-section rods of the second set of rods occluding each gap between the rods of the first set so that the filling device is once more functioning as a shutter at the base of the hopper.

Having described what is to be seen in drawing FIGS. 2 and 6, it will be a relatively simple task for readers to follow the cycle of movement of the filling device through the successive stages shown in sections FIG. 7 through to FIG. 12.

Figure 3:
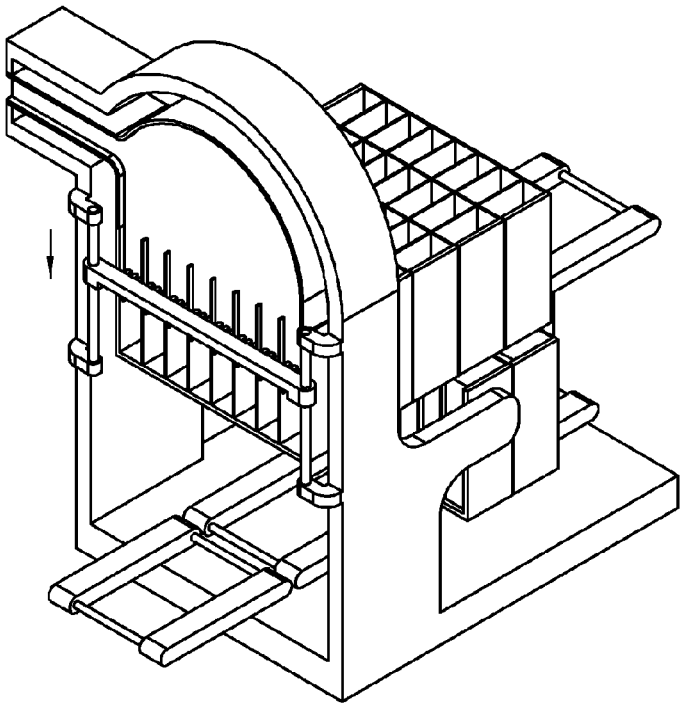
FIG. 3 shows the station of FIG. 2, in a third disposition, with the tray part-filled.

Taking first FIG. 7, with isometric view FIG. 3, we see that the filling device has descended in the cavity 54 to a level B part of the way down the depth of the cavity 54. There has been no relative movement of the bars of the first and second sets of the filling device. A mass flow of product rods from the hopper 9 passes under gravity into the top of the column 54 and it can be seen from the schematic representation in FIG. 7 that the rods above the filling device 12 are not perfectly close packed. The filling device is descending slowly. The tray 14 and the hopper 9 are not moving relative to each other at all and, if the descent of the filling device 12 is gentle enough, there should be no damage to any of the product rods descending under gravity into the columnar cavity 54.

Figure 4:
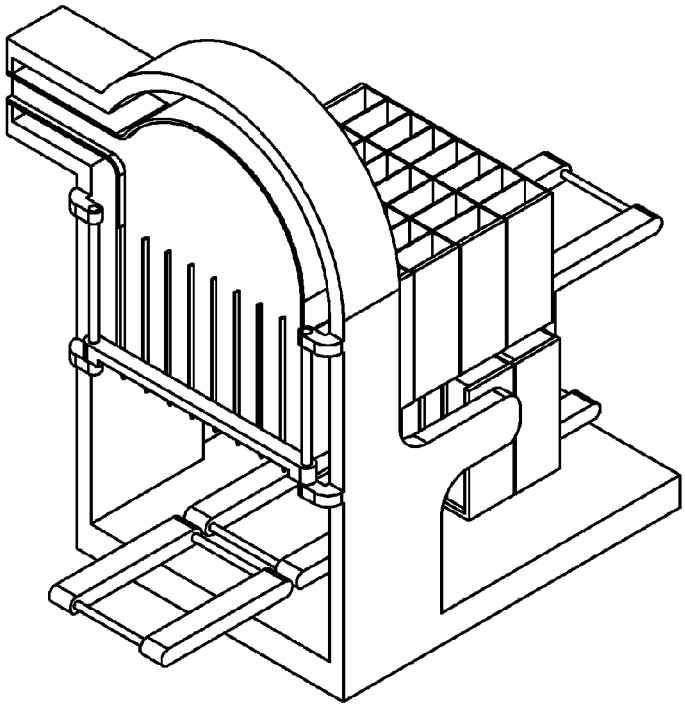
FIG. 4 shows the station of FIGS. 2 and 3, in a fourth disposition, with the tray now full.
Figure 5:
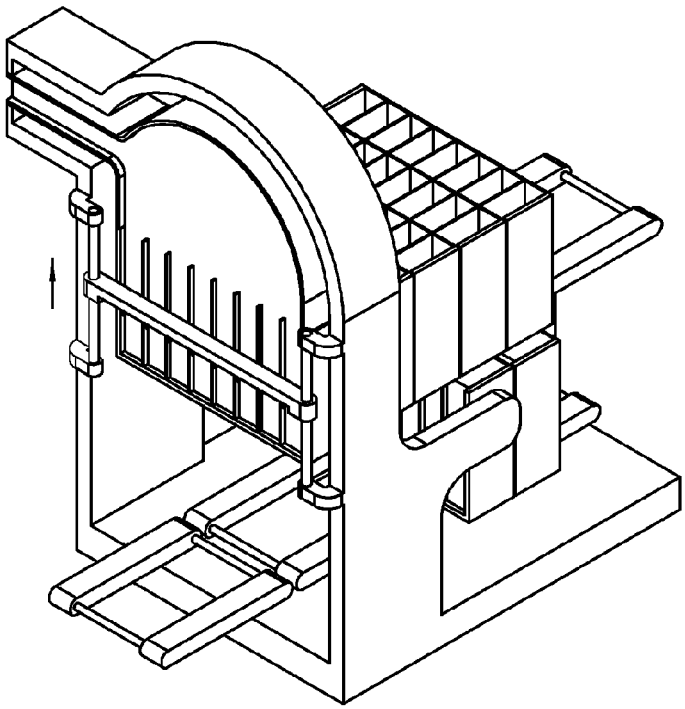
FIG. 5 shows the station of FIGS. 2 to 4, with the cavity-filling device undergoing its upstroke, through the full columns of the tray.
Figure 8:
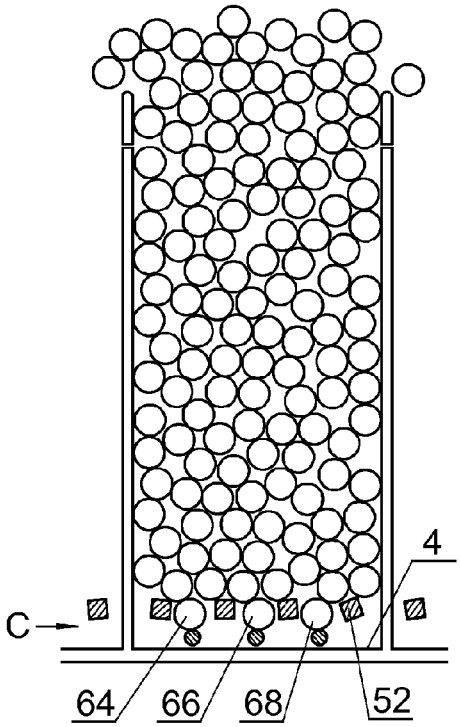
FIG. 8 is a section like FIGS. 6 and 7, showing the filling device at the end of its downstroke, corresponding to the FIG. 4 disposition of the filling station.

Moving on to FIG. 8 and FIG. 4, we see the filling device 12 at level C, corresponding to the bottom of its downstroke, with the circular section bars 62 unable to descend any further, because they are up against the base surface 4 of the columnar cavity. Note that each of the bars 62 has unobstructed free space either side of it, so is free to move laterally relative to the upper set of square bars 62. For the time being, however, the bars 62 continue to block any downward flow of product rods past the square bars 62.

Figure 9:
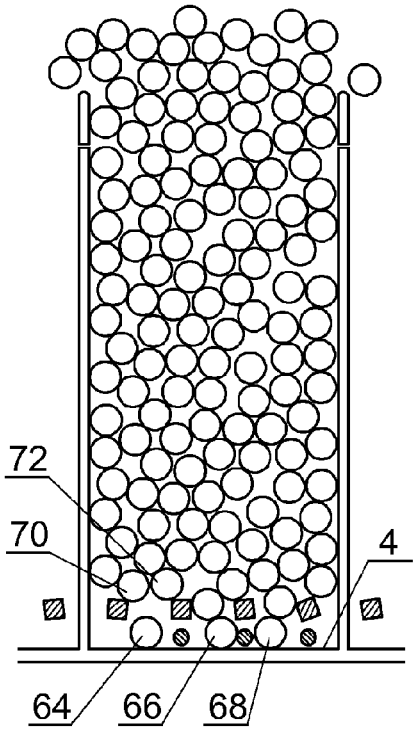
FIG. 9 is a section like that of FIGS. 6, 7 and 8 but showing the filling device about to commence its upstroke from the floor of the cavity, with each circular bar of the second set now in a disposition immediately below a rectangular bar of the first set of bars of the filling device.

The position changes in FIG. 9, however, with lateral movement of the round bars 62, each into a position vertically below a corresponding square bar 52. Suddenly, there is no longer any impediment to downward flow of product rods though the gaps between the square bars 52. We see in FIG. 9 that the three rods 64, 66 and 68 that in FIG. 8 were located level with the square bars 52 have now been able to fall between the gaps, freely under gravity, until they come to rest on the floor surface 4 of the columnar cavity. Attention is also directed to the product rod items 70 and 72 directly above the product rod 62 lying on the base of the storage cavity 54. Each of the rods 70 and 72 rests against the other one, and also against one of the square bars between which the product rod 64 has past downwardly. One can envisage that the two product rods 70 and 72 could stay indefinitely in a "bridged" position above the square bars of the filling device.

Figure 10:
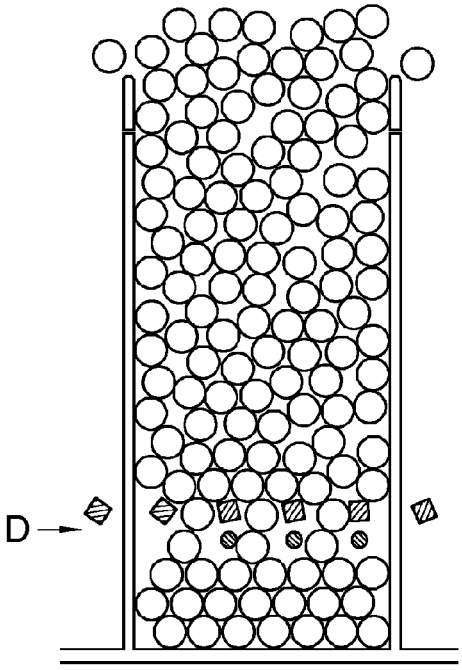
FIG. 10 is a section like that of FIGS. 6 to 9, but with the filling device part of the way through its upstroke.

Moving on to FIG. 10, however, we see the filling device 12 at level D, some distance above the base of the cavity 54. Furthermore, we see three close packed rows of product rods below level D. We do not see in the drawings the oscillatory rotatory movement of the square bars 52, as the filling device 12 ascends through the bed of product rods in the storage cavity 54, but we can imagine that oscillation, and how it might frustrate any incipient bridging tendency and thereby assist the downward flow of product rods through the gaps between the bars 52, and how it might further assist those product rods emerging downwardly from the gaps between the square bars 52 in taking up a close packed disposition as shown below level D in FIG. 10.

Figure 11:
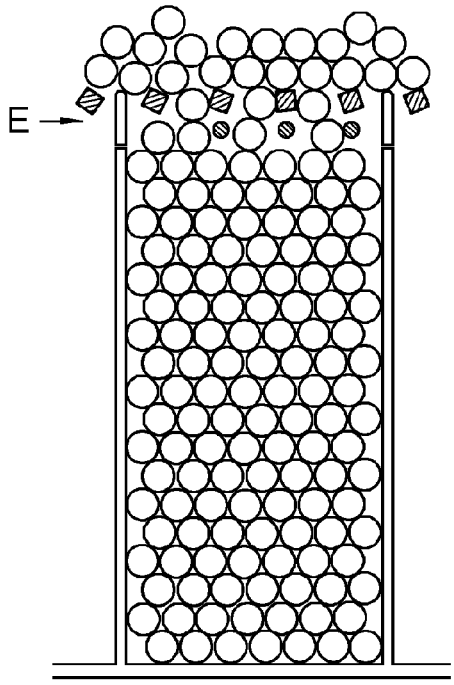
FIG. 11 is a section like that of FIGS. 6 to 10, showing the filling device having reached the top of its upstroke, but not yet serving as a shutter.

The filling device continues to rise through the bed of product rods, until it reaches the disposition shown in FIG. 11, at the top of the storage cavity, at level E, which is the same as level A in FIG. 6. In FIG. 11, however, the circular section rods 62 have not yet moved back across to the starting disposition shown in FIG. 6, where they occlude the gaps between square bars 52 to prevent further downward flow of product rods from the hopper 9. This disposition is shown in FIG. 12, which corresponds to that of FIG. 6 except that, in FIG. 12, the full tray below the tray filler has not yet been taken away and replaced by an empty tray such as we see in FIG. 6.

Not shown in the drawings, for reasons of clarity, are the various sensors, control devices and actuators that monitor and control the filling process. Specifically, an array of fullness sensors (known per se) can be arranged just below the cavity-filling device to ensure that each single cavity has been properly filled. In the event of improper filling of one or more cavities, the tray can be discharged from the filling station along conveyor 18 instead of conveyor 10.

Drawing FIGS. 11 and 12 suggest to the viewer that the effect of the filling device is to deliver in the columnar cavity 54 an arrangement of product rods that is perfectly close packed. The Applicant does not make the claim that his filling device will always deliver perfect close packing of rods. It is merely suggested that the filling device which is the subject of this patent application offers some potential to deliver improvements in the degree of close packing that is achievable in the conventional trays used for temporary storage of cigarette rods and other tobacco products in the present day tobacco industry.

Figure 13:
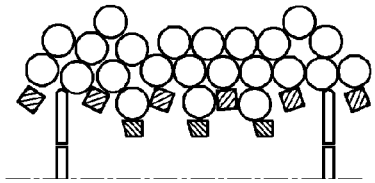
FIGS. 13, 14 and 15 are scrap sections of the upper part of the cavity being filled, each showing a different alternative cross-section for the bars of the cavity-filling device.
Figure 14:
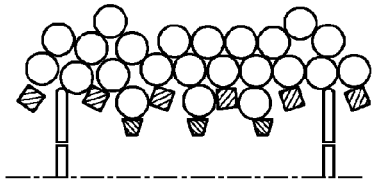
Figure 15:
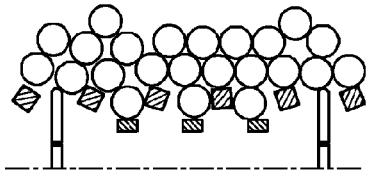

Moving on, we turn now to drawing FIGS. 13 to 15. Each is a scrap of a section corresponding to FIG. 6 and each shows a different shape of the cross-section of each bar 62 of the second set of bars. Thus, the bars in FIG. 13 have opposed flat parallel upper and lower faces and, linking them, one face that is orthogonal to both of the upper and lower faces and one that is somewhat inclined to the other face linking the upper and lower surfaces. Such a shape might be advantageous when the inclined face is the leading face when the second set of bars translates from the open to the closed configuration at the top of the columnar cavity, gently urging downwardly into the cavity any rod-shaped article that must be pushed aside before the cavity-filling device can reach its closed configuration.

As to FIG. 14, here we see both faces linking the upper and lower faces of the quadrilateral cross-section of the rods 62 being inclined to these faces at other than 90°, and symmetrical to each other. Such arrangement of rods 62 facilitates widening of the through channel in the region of the second set of rods. In this way, the bars can gently urge rod articles downwards both when the bars move into the closed configuration and when they move into the open configuration.

As to FIG. 15, we see bars 62 of a rectangular cross-section, but wider than they are thick. Where height constraints are severe, this shape might be advantageous, allowing minimisation of the height difference between the base of the hopper and the base of the tray being filled.

Figure 16:
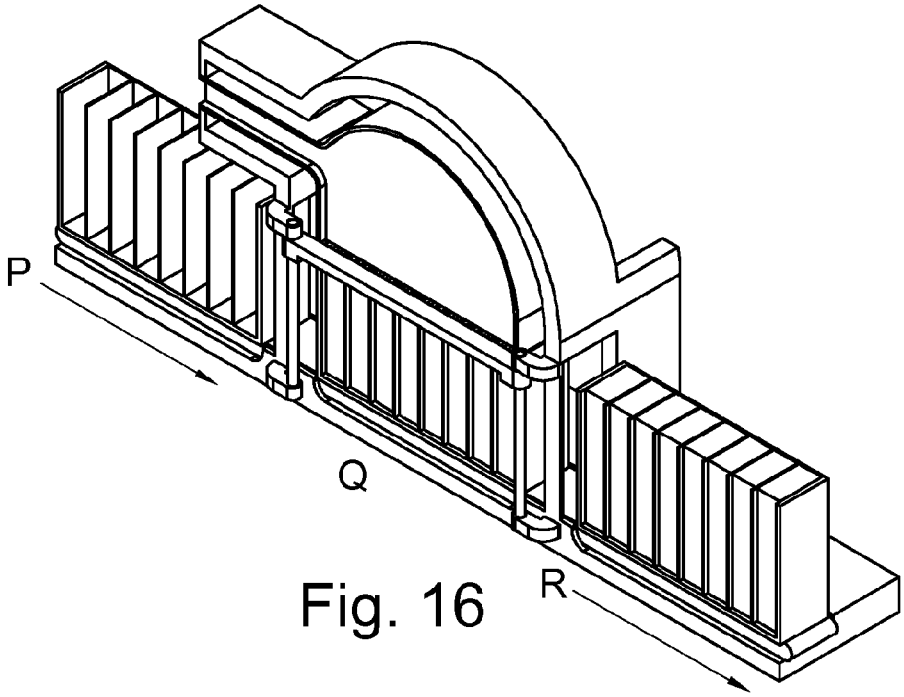
FIGS. 16 and 17 are isometric views like those of FIGS. 1 and 2, each showing a different infeed/output architecture for the trays being filled at the filling station.

Moving on to FIG. 16, here we see an "In Line" filling station in which empty trays advance in direction P into filling station Q, before advancing further along a tray conveyor as shown by arrow R.

Figure 17:
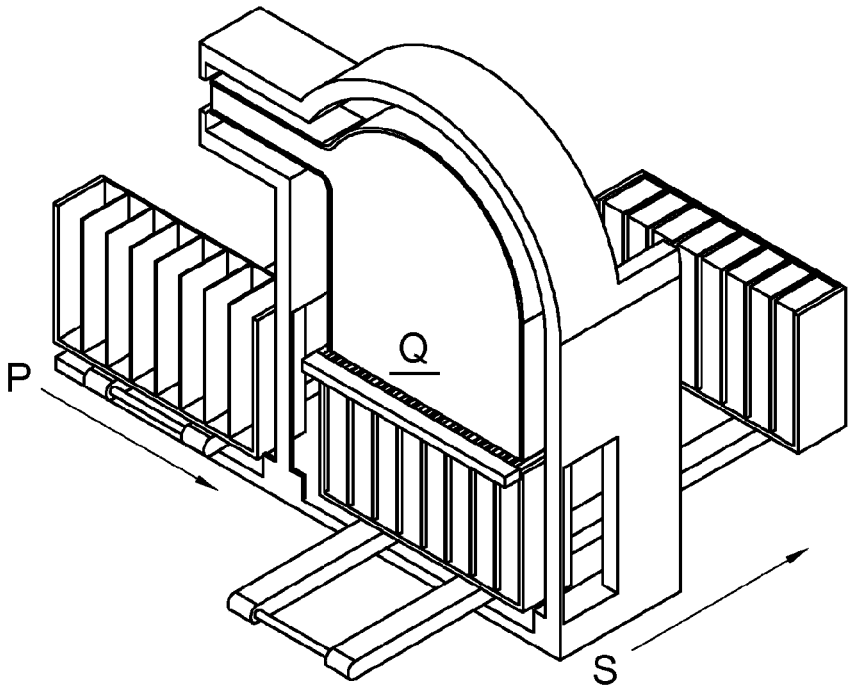

In contrast, FIG. 17 shows a similar infeed along arrow P into filling station Q, but an output in a direction S perpendicular to infeed conveyor P. Skilled readers will understand that various dispositions of infeed and output are possible, the arrangement being chosen being the one that meets best the customer's available accommodation for the filling station.

Figure 18:
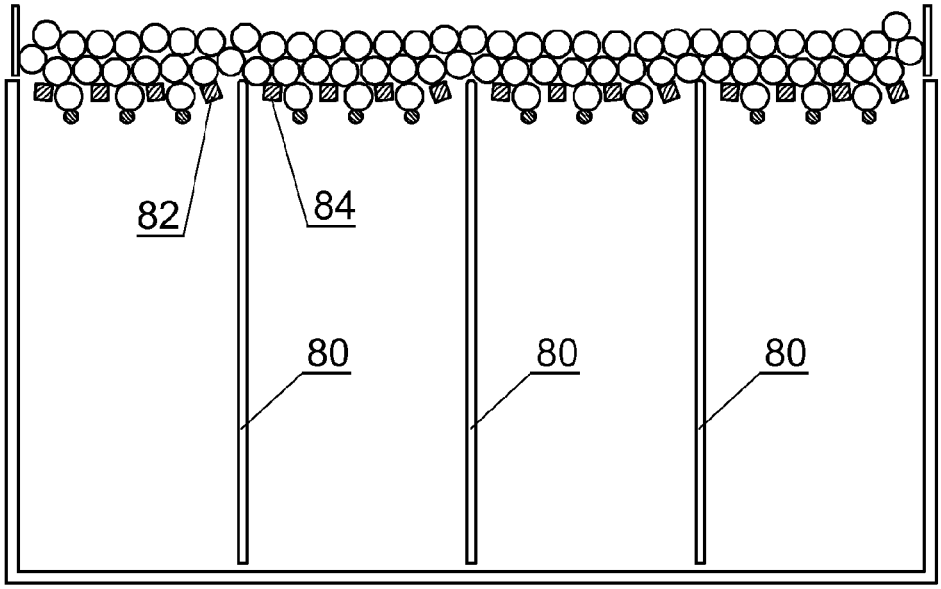
FIG. 18 shows a single cavity tray in front elevation, with a cavity-filling device above, and temporary dividing walls within the tray cavity at the filling station.

In FIG. 18, we see a single cavity tray in a filling station with a cavity-filling device with gaps between the bars 52 of the upper set of bars. Between two adjacent bars such as 82 and 84, there is no member of the set of lower bars 62, the gap instead being filled by one of a temporary dummy wall 82. The reader will appreciate that selective removal of lower bars 62, and replacement by dummy walls 80, can provide at the filling station as many or as few temporary columnar cavities within the volume of the tray as the operator of the process pleases. In passing, the reader will appreciate from FIG. 18 how it is that the filling device with a single set of upper bars 52 of uniform spacing can be modified (by selective removal of lower bars 62) to suit trays with different numbers of columnar cavities.

After the tray has been filled, the dummy walls in the filling station can be withdrawn from the full tray. One possibility is to withdraw them upwardly, through the open top of the full tray. Another possibility is to withdraw them laterally, away from the back wall of the full tray. Whatever architecture is selected will be the one that is fitting to the available space for the tray filling station. The dummy wall placement in the tray and removal from it, before and after the tray is filled, can naturally be integrated with movements of the cavity-filling device, and automated.

Figure 19:
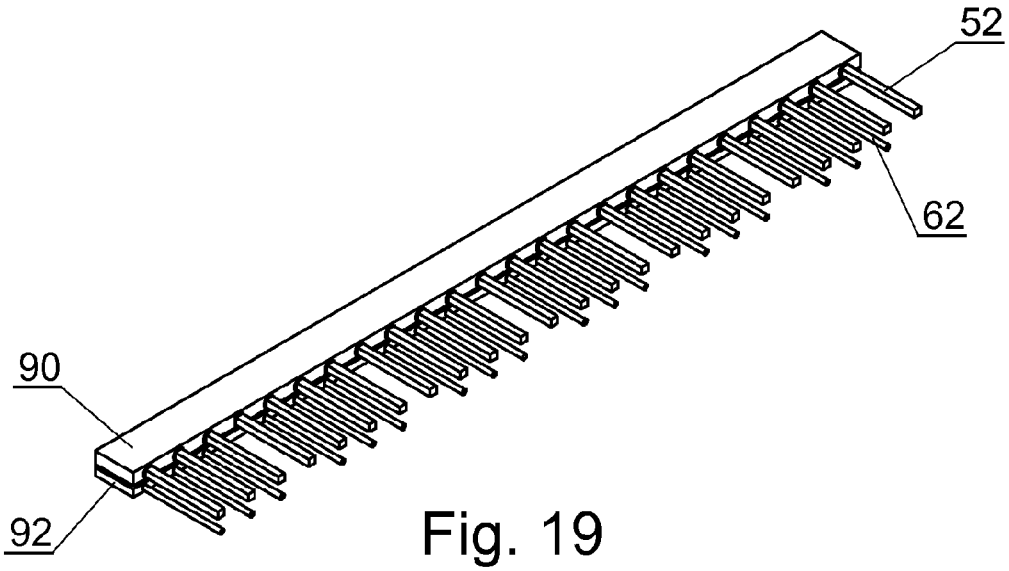
FIG. 19 shows part of the length of a cavity-filling device, in isometric view.

Turning to FIG. 19, we see a portion of the length of a cavity-filling device with an upper set of bars 52 and a lower set of bars 62. The upper set of bars is cantilevered from a beam 90 and the lower set from its own beam 92. Not shown are drive and suspension means whereby the lower beam 92 can be moved in translation, relative to the upper beam 90, between the open and the closed configurations of the device. Also not shown (but realisable nevertheless by those skilled in the art) are the means whereby the bars can be oscillated or vibrated as desired. FIGS. 1 to 5 show where the beams 90, 92 are installed in the device 12 to function within the filling station.

The drawings show only a few embodiments, and only schematically. The skilled reader will understand from the disclosure how to put the invention into effect, over the scope of the claims which follow. The reader will also understand the details of the tobacco equipment industry, and therefore how to transform the schematic disclosures above into practical engineering solutions for integration into a fully-functioning commercial scale production line.

The invention claimed is:

1. Apparatus for filling under gravity from a hopper, a storage device for articles that has the form of a columnar cavity between opposed side walls, with a mass flow of mutually parallel rod-shaped articles descending from the hopper, and characterized in that:

a cavity-filling device (12) for filing the cavity (2, 14, 15, 16) that alternates in use between a closed configuration that blocks a downward flow of the said articles through the device (12) and an open configuration that allows flow of the articles through the device (12), the device (12) being movable in translation, in alternate upward and downward strokes within the cavity (2, 14, 15, 16), being in the closed configuration on the downward stroke and in the open configuration on the upward stroke.

2. The apparatus according to claim 1, wherein the cavity-filling device (12) comprises a first set of mutually parallel co-planar elongate bars (52), the bars (52) of the first set being spaced apart at regular intervals widely enough to permit the articles to slide between the bars (52), and a second set of mutually parallel co-planar bars (62), the bars (62) of the second set being spaced apart at regular intervals such that, in the closed configuration, at least one bar (62) of the second set obstructs each gap between the bars (52) of the first set through which articles flow when the device (12) is in its open configuration.

3. The apparatus according to claim 2, wherein the bars (52) of the first set have a rectangular cross-section and are mounted for rotary motion.

4. The apparatus according to claim 2, wherein the bars (62) of the second set have a circular cross-section.

5. The apparatus according to claim 2, wherein alternation between the said open and closed configuration is accomplished by a relative movement of the first bar (52) and second bar (62) sets in translation, transverse to the upward and downward direction.

6. The apparatus according to claim 5, wherein the bars (52) of the first set are rotatably mounted on a support and the bars (62) of the second set are mounted on a horizontally moveable beam arranged below of the bars (52) of the first set.

7. The apparatus according to claim 1 for filling a storage device (2) which is a tray that has a plurality of side walls that defines a single row of said columnar cavities (54), the apparatus being adapted to fill simultaneously a plurality of the columnar cavities (54) in the row.

8. The apparatus according to claim 1 and including said hopper (9) and wherein the cavity-filling device (12) prior to its downward stroke serves in its closed configuration as a shutter that closes an outlet in the base of the hopper (9).

9. The apparatus according to claim 1 and including means to actuate the cavity-filling device (12) in dependence upon the fill state of the storage device (2, 14, 15, 16) beneath the cavity-filling device (12).

10. The apparatus according to claim 1, and including means to move the cavity-filling device (12) upwards at a steady speed and downwards at a steady speed.

11. A filling station for filling a succession of empty storage devices with mutually parallel rod-shaped articles, the filling station (1) comprising a hopper (9), a filling apparatus according to claim 1, and a transport device for advancing a succession of the empty storage devices (2, 14, 15, 16) to a filling position beneath the filling apparatus and then advancing the storage devices (2, 14, 15, 16), when full, out of the filling position.

12. A method for filling a succession of storage devices (2, 14, 15, 16) under gravity from a hopper (9), with a mass flow of mutually parallel rod-shaped articles, each storage device (2, 14, 15, 16) having the form of a columnar cavity between opposed side walls, the method characterised in that it comprises the steps of:

arranging a cavity-filling device (12) under the hopper (9), the device (12) is in a closed configuration that blocks a downward flow of the said articles through the device (12);

placing an empty storage device (2, 16) under the cavity-filling device (12);

moving the cavity-filling device (12) downward as far as a base wall of the storage device (2, 16);

shifting the device (12) from the closed configuration to an open configuration that allows flow of the articles through the device (12);

moving the device (12) upwards close to a top of the storage device (2, 16);

shifting the device (12) from the open configuration to the closed configuration; and replacing the filled storage device (2, 16) with another empty storage device (2, 16).

13. The method according to claim 12, wherein the cavity-filling device (12) comprises a first set of mutually parallel co-planar elongate bars (52), the bars (52) of the first set being spaced apart at regular intervals widely enough to permit the articles to slide between the bars (52), and a second set of mutually parallel co-planar bars (62), the bars (62) of the second set being spaced apart at regular intervals thereby providing such that at least one bar (62) of the second set obstructs each gap between the bars (52) of the first set when shifting the device (12) from the open configuration to the closed configuration, and wherein the shifting step comprises shifting the bars (62) of the second set laterally with respect to the bars (52) of the first set of bars and the tray.

14. The method according to claim 13, further comprising the step of:

performing a rotary motion of the bars (52) of the first set and/or the bars (62) of the second set during upward and/or downward movement.

15. The method according to claim 12, further comprising the step of:

moving the cavity-filling device (12) upwards and downwards at a constant speed.

16. The method according to claim 12, wherein the method is used to fill simultaneously a plurality of the columnar cavities of a multi-compartment tray (16).

* * * * *